United States Patent [19]

Kaloi

[11] 3,978,487

[45] Aug. 31, 1976

[54] COUPLED FED ELECTRIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[22] Filed: Apr. 24, 1975

[21] Appl. No.: 571,155

[52] U.S. Cl. ..... 343/829; 333/84 M

[51] Int. Cl.[2] ..... H01Q 1/38

[58] Field of Search..... 343/846, 908, 829; 333/84 M

[56] References Cited

UNITED STATES PATENTS 3,016,536 1/1962 Fubini..... 343/829

*Primary Examiner*—Eli Lieberman

*Attorney, Agent, or Firm*—Richard S. Sciascia; Joseph M. St.Amand

[57] ABSTRACT

A coupled fed electric microstrip dipole antenna consisting of a thin electrically conducting, rectangular-shaped radiating element (resonator) and a nonradiating coupler formed on one surface of a dielectric substrate, the ground plane being on the opposite surface. There is only a single mode of oscillation. Oscillation takes place along the length of the radiating element, and the length determines the resonant frequency. The feed point is normally located at the end of the coupler; energy is in turn coupled to the radiating element. Input impedance matching is determined by a combination of the coupler length and the separation between the coupler and the radiating element.

9 Claims, 10 Drawing Figures

XY PLANE PLOT
2268 MHz Eø

XZ PLAN PLOT
2268 MHz Eθ

COUPLED FED ELECTRIC MICROSTRIP DIPOLE ANTENNA

This invention is related to copending U.S. Patent applications:

Ser. No. 571,154 for DIAGONALLY FED ELECTRIC MICROSTRIP DIPOLE ANTENNA;

Ser. No. 571,156 for END FED ELECTRIC MICROSTRIP QUADRUPOLE ANTENNA;

Ser. No. 571,157 for OFFSET FED ELECTRIC DIPOLE ANTENNA;

Ser. No. 571,152 for CORNER FED ELECTRIC MICROSTRIP DIPOLE ANTENNA;

Ser. No. 571,153 for NOTCH FED ELECTRIC MICROSTRIP DIPOLE ANTENNA; and

Ser. No. 571,158 for ASYMMETRICALLY FED ELECTRIC MICROSTRIP DIPOLE ANTENNA;

all filed together herewith on Apr. 24, 1975 by Cyril M. Kaloi.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas. The specific type of microstrip antenna described herein is the "coupled fed electric microstrip dipole." Reference is made to the "electric microstrip dipole" instead of simply the "microstrip dipole" to differentiate between two basic types; the first being the electric microstrip type, and the second being the magnetic microstrip type. The coupled fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately ½ wavelength. The width may be varied depending on the desired electrical characteristics. The conducting ground plane is usually much greater in length and width than the radiating element.

The magnetic microstrip antenna's physical properties are essentially the same as the electric microstrip antenna, except the radiating element is approximately ¼ the wavelength and also one end of the element is grounded to the ground plane.

The thickness of the dielectric substrate in both the electric and magnetic microstrip antenna should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (e.g., a microstrip-monopole mode) above 25 GHz for most stripline materials commonly used. For clad materials thinner than 0.031 inch higher frequencies can be used. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile. The present antenna element is not grounded to the ground plane.

Advantages of the antenna of this invention over other similar appearing types of microstrip antennas is that the present antenna can be fed very easily from the ground plane side and has a slightly wider bandwidth for the same form factor.

The coupled fed electric microstrip dipole antenna consists of a thin electrically-conducting, rectangular-shaped radiating element (resonator) and a nonradiating coupler formed on the surface of a dielectric substrate; the ground plane is on the opposite surface of the dielectric substrate and the microstrip antenna element is fed from a coaxial-to-microstrip adapter, with the center pin of the adapter extending through the ground plane and dielectric substrate to the nonradiating coupler. The length of the antenna radiating element determines the resonant frequency. The feed point is normally located at the end of the coupler; however, other arrangements such as feeding along the uncoupled edge of the coupler is possible. The energy is in turn coupled to the radiating element in the same manner as a directional coupler. The oscillation takes place along the length of the radiating element. Impedance matching is determined by a combination of the coupler length and separation between the coupler element and the resonator element. The radiation pattern changes very little within the bandwidth of operation.

DESCRIPTION AND OPERATION

Figure 1:
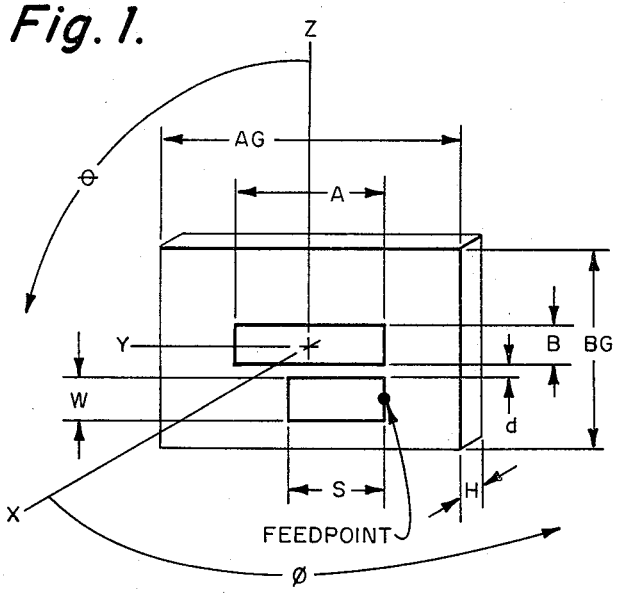
FIG. 1 illustrates the alignment coordinate system used for the coupled fed electric microstrip dipole antenna.

The coordinate system used and the alignment of the antenna element within this coordinate system are shown in FIG. 1. The coordinate system is in accordance with the IRIG standards and the alignment of the antenna element was made to coincide with actual antenna radiation patterns that will be discussed later. The antenna is made from copper cladded dielectric material. The antenna consists of a radiating element (resonator) and a nonradiating coupler parallel to and spaced apart from the radiating element, and lying in the same plane. The B dimension is the width of the antenna radiating element. The A dimension is the length of the antenna radiating element. The H dimension is the height of the antenna element and antenna coupler above the ground plane and is also the thickness of the dielectric. The W dimension is the width of the coupler. The S dimension is the length of the coupler. The AG dimension and the BG dimension are the length and the width of the ground plane respectively. The angles $\theta$ and $\phi$ are measured per IRIG standards. The above parameters are measured in inches and degrees.

Figure 2A:
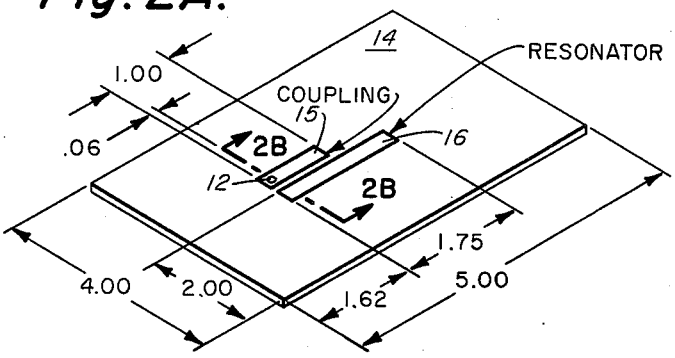
FIG. 2A is an isometric planar view of a typical coupled fed electric microstrip dipole antenna.
Figure 2B:
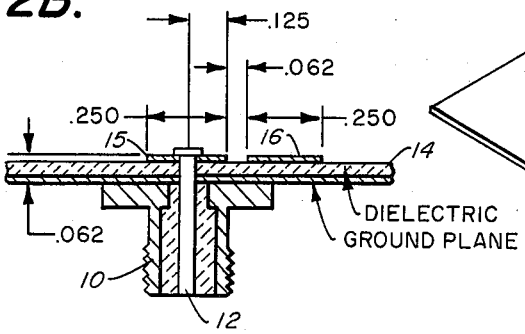
FIG. 2B is a cross-sectional view taken along section line B—B of FIG. 2A.
Figure 3:
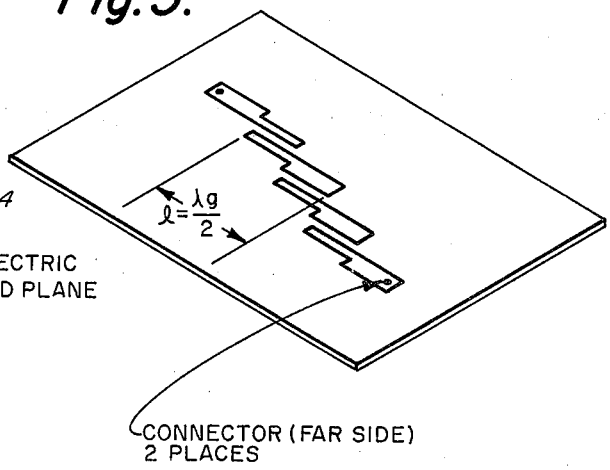
FIG. 3 shows a typical parallel coupled stripline filter.

FIGS. 2A and 2B show a typical coupled fed electric microstrip dipole antenna of the present invention. This antenna is illustrated with the dimensions given in inches as shown by way of example, and curves for the typical antenna illustrated are shown in later figures. The antenna is fed from a coaxial-to-microstrip adapter 10, with the center pin 12 of the adapter extending through the dielectric substrate 14 and connected to the feed point on microstrip coupler 15. Coupler 15 is normally fed on the end. However, other feeding arrangements, such as feeding along the uncoupled edge of the coupler is possible. The energy is in turn coupled to the radiating element (i.e., resonator) 16 in the same manner as a directional coupler. The microstrip antenna can be fed with most of the different types of coaxial-to-microstrip launchers presently available. The dielectric substrate 14 separates the element 16 or 17 from the ground plane 18 electrically. The configuration shown in FIGS. 2A and 2B is very easily resonated and easily matched to most practical impedances. The oscillation takes place along the length of antenna element 16. The idea for the coupled microstrip dipole antenna evolved from a parallel coupled stripline filter of the type shown in FIG. 3, where some leakage radiation was observed.

The antenna is resonated by trimming the A dimension to approximately one half the waveguide wavelength. The impedance matching is determined by a combination of the coupler length S and separation (i.e., distance $d$) between the coupler 15 and the resonator 16. An experimental procedure to match the antenna is to choose a separation $d$ and then trim the coupler 15 until a match occurs. If the separation $d$ is too wide a match may not be possible. The selection of the separation width is presently a cut and try process. If the separation width is kept less than 0.62 inches, a match is possible for most configurations. There are many combinations of the coupler length S and the separation width $d$ to effect a good match and this is shown in FIG. 4 and FIG. 5.

Figure 4:
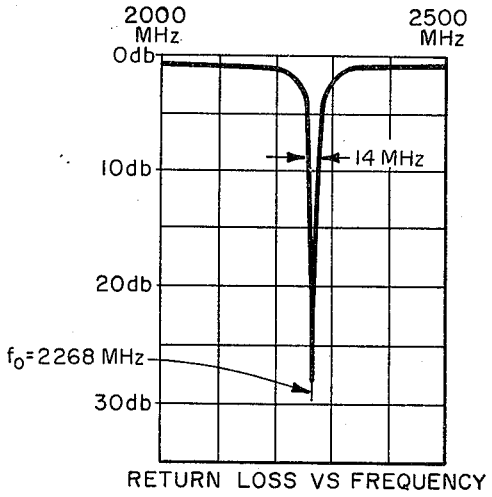
FIG. 4 is a plot showing the return loss versus frequency for a coupled fed antenna having the dimensions shown in FIGS. 2A and 2B.
Figure 5:
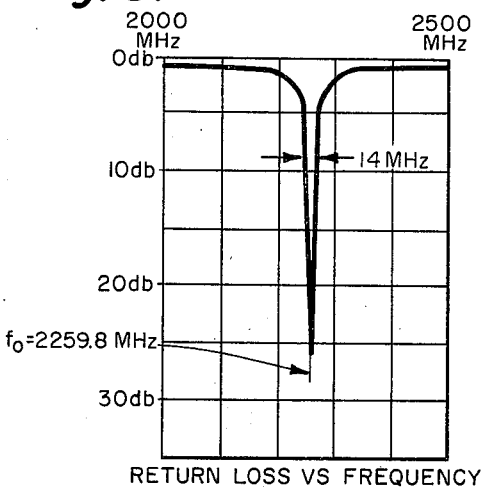
FIG. 5 is a plot showing the return loss versus frequency for a coupled fed antenna having the coupler dimensions varied from that shown in FIGS. 2A and 2B.

FIG. 4 shows a plot of return loss vs. frequency for the configuration shown in FIG. 2. FIG. 5 shows a return loss vs. frequency for the same type configuration except that the length S of coupler 15 is reduced from 1.0 inch to one-half inch and the separation $d$ between coupler 15 and resonator 16 is reduced to .031 inch from .062 inch. These two plots (i.e., FIGS. 4 and 5) show that the resonant frequency and bandwidth are essentially the same.

Varying the position of the coupler along the length of the radiating element will vary the antenna electrical characteristics. The copper losses in the clad material determine how narrow the element can be made. The length of the radiating element determines the resonant frequency of the antenna, about which more will be mentioned later. It is preferred that both the length and the width of the ground plane be at least one wavelength ($\lambda$) in dimension beyond each edge of the element to minimize backlobe radiation.

Figure 6:
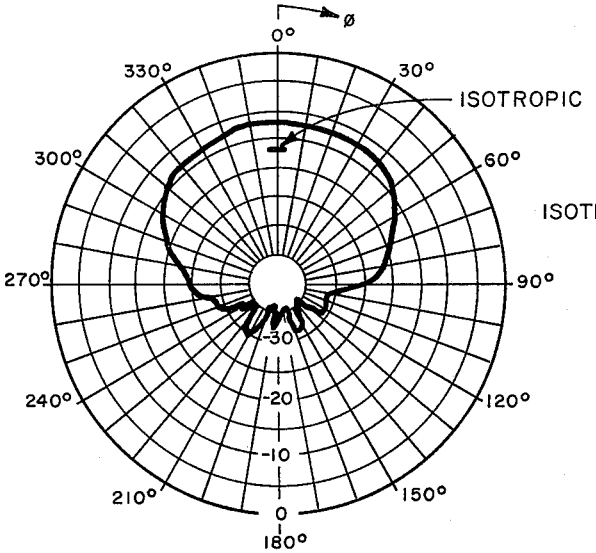
FIG. 6 shows the antenna radiation pattern (XY-Plane plot) for the coupled fed antenna shown in FIGS. 2A and 2B.
Figure 7:
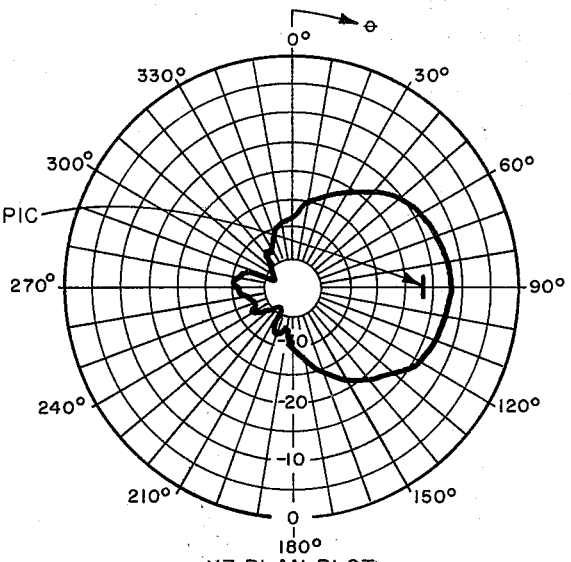
FIG. 7 shows the antenna radiation pattern (XZ-Plane plot) for the coupled fed antenna shown in FIGS. 2A and 2B.

FIGS. 6 and 7 show antenna radiation patterns for the antenna element of FIGS. 2A and 2B. Only E-plane (XY-plane) plots and H-plane (XZ-plane) plots are shown. Cross-polarization energy is minimal and is therefore not included. Polarization of the antenna is linear along the length of the antenna. The E-plane plot is the measurement made in the plane parallel to the E field (i.e., polarization field). The H-plane plot is the measurement made normal to the E field. Note that beam width narrowing effects are due to ground plane effects.

Figure 8:
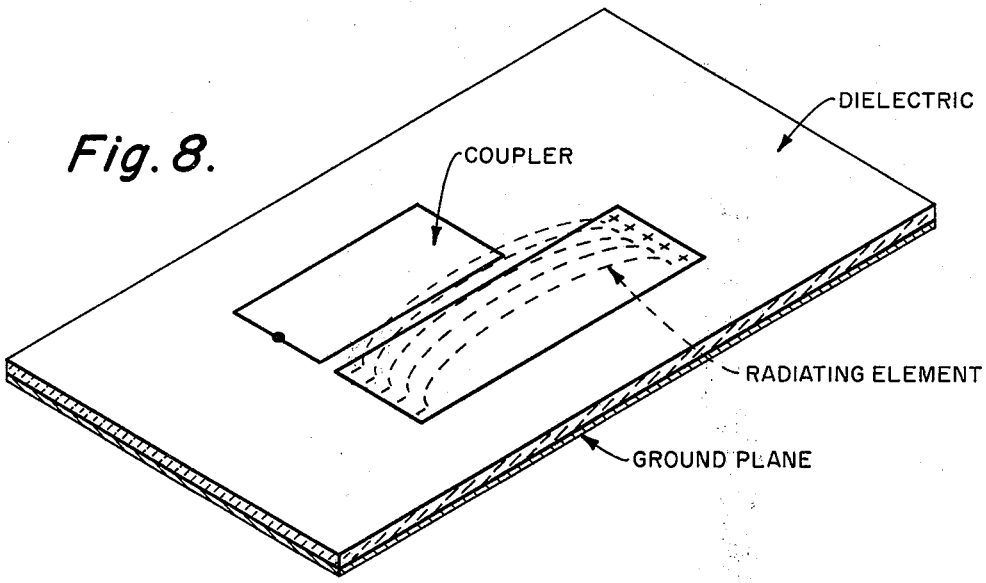
FIG. 8 illustrates the general configuration of the near field radiation of the coupled fed antenna.

A typical near field radiation configuration is shown in FIG. 8. The radiation is vertical along the length of the element. It is possible to have some horizontal radiation when the input impedance is matched for the horizontal oscillating mode and also the radiation resistance for the horizontal mode is greater than the copper loss resistance.

Figure 9:
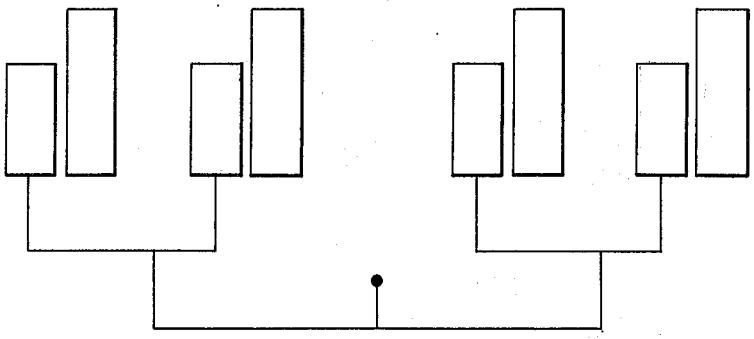
FIG. 9 shows a general arraying configuration, using microstrip transmission line, for a plurality of coupled fed antennas.

A plurality of the antennas can be arrayed as shown in FIG. 9, for example, using microstrip transmission line.

Obviously many modifications and variations of the present invention are possible in the light of the above teachings. It is therefore to be understood that within the scope of the appended claims the invention may be practiced otherwise than as specifically described.

I claim:

1. A coupled fed electric microstrip dipole antenna having low physical profile and conformal arraying capability, comprising:

a. a thin ground plane conductor;

b. a thin rectangular microstrip radiating element and a separate smaller thin rectangular shaped microstrip nonradiating coupler alongside and spaced apart from said radiating element;

c. said radiating element and nonradiating coupler being parallel to each other in the same plane and equally spaced from said ground plane;

d. said radiating element and nonradiating coupler being electrically separated from said ground plane by a dielectric substrate;

e. said nonradiating coupler being fed from a coaxial-to-microstrip adapter, the center pin of said adapter extending through said ground plane and dielectric substrate to a feedpoint on said nonradiating coupler;

f. the length of said radiating element determining the resonant frequency of said antenna;

g. the antenna input impedance being variable to match most practical impedances by varying the coupler length and the distance between said radiating element and nonradiating coupler without affecting the antenna radiation pattern.

2. An antenna as in claim 1 wherein the ground plane conductor extends at least one wavelength in each direction beyond the edges of the antenna element to minimize any possible backlobe radiation.

3. An antenna as in claim 1 wherein the feedpoint of said nonradiating coupler is at one end of the centerline along the length thereof.

4. An antenna as in claim 1 wherein a plurality of said radiating elements are arrayed to provide a near isotropic radiation pattern.

5. An antenna as in claim 1 wherein the length of said radiating element is approximately ½ wavelength.

6. An antenna as in claim 1 wherein the feedpoint of said nonradiating coupler is along the uncoupled edge of the coupler, which is farthest away from said radiating element.

7. An antenna as in claim 1 wherein said thin rectangular radiating element and coupler are formed on one surface of said dielectric substrate.

8. An antenna as in claim 1 wherein the minimum width of said radiating element is determined by the equivalent internal resistance of the conductor plus any loss due the dielectric.

9. An antenna as in claim 1 wherein the antenna electrical characteristics are varied by varying the position of said nonradiating coupler alongside the length of said radiating element.

* * * * *